United States Patent [19]

Shaffer et al.

[11] 3,972,410

[45] Aug. 3, 1976

[54] APPARATUS FOR DIVERTING PIPE TO A PLURALITY OF BEDS OR THE LIKE

[75] Inventors: Ralph M. Shaffer, Allison Park; Jerzy F. Patejak, Wampum, both of Pa.

[73] Assignee: Aetna-Standard Engineering Company, Ellwood City, Pa.

[22] Filed: Dec. 2, 1974

[21] Appl. No.: 528,711

[52] U.S. Cl. ..... 198/31 AC

[51] Int. Cl.[2] ..... B65G 47/26

[58] Field of Search ..... 198/31 R, 31 AB, 31 AC, 198/104, 127 R; 214/1 P; 83/105, 106, 156, 81, 82

[56] References Cited

UNITED STATES PATENTS

| | | | |
|---|---|---|---|
| 1,427,325 | 8/1922 | Quick | 198/31 AC |
| 2,670,835 | 3/1954 | Huttmann | 198/31 AC |
| 3,138,047 | 6/1964 | Sennello | 83/106 |
| 3,260,346 | 7/1966 | Gleve | 198/31 AC |
| 3,342,302 | 9/1967 | Ledebur | 198/31 AC |

FOREIGN PATENTS OR APPLICATIONS

| | | | |
|---|---|---|---|
| 187,588 | 2/1964 | Sweden | 198/31 AC |

*Primary Examiner*—John J. Love
*Assistant Examiner*—Joseph E. Valenza
*Attorney, Agent, or Firm*—Mandeville and Schweitzer

[57] ABSTRACT

An improved pipe mill is disclosed having two cooling beds and a dual conveyor for delivering cut lengths of pipe from a saw to both beds in two paths, whereby the mill can be operated at very high speeds. A unique selector unit is provided having an oscillating deflector for diverting successive cut lengths of pipe from one conveyor path to the other in timed relation to the operation of the saw and having a special cam actuating unit which can be operated in three different ways to cause delivery of pipe to either one or both of the cooling beds. The cam unit includes a rotating cam wheel having a flat flange at one side and a contoured flange at the opposite side which is engageable with a cam roller or follower to cause reciprocation of the deflector with a dwell at each of its advanced and retracted positions. The cam wheel is movable axially by an air cylinder while the cam roller is held in a non-operating position against the flat flange so that the deflector can be held stationary in either one of its advanced and retracted positions.

13 Claims, 9 Drawing Figures

APPARATUS FOR DIVERTING PIPE TO A PLURALITY OF BEDS OR THE LIKE

BACKGROUND OF THE INVENTION

The present invention relates to an improved pipe mill having special equipment to permit operation of the mill at very high speeds and more particularly to a mill having at least two cooling beds, at least two conveyors for delivering the cut lengths of pipe to both beds, and a unique selector unit having an oscillating deflector means for directing the pipe lengths alternately to both cooling beds or to only one of the beds.

In a conventional pipe mill, hot pipe is produced continuously in pipe forming apparatus which is capable of operating at speeds of 1 to 2000 feet per minute or more. The pipe, while hot, is severed, as by sawing, into commercial lengths of, for example, 20 to 40 feet as the pipe leaves the mill. A flying saw may be used to effect the cutting without stopping movement of the pipe.

The rapidly moving lengths of pipe severed by the saw are moved longitudinally on a conveyor successively onto a cooling bed where they are conveyed transversely of their axes by screw conveyors and while so moving are permitted to cool.

It is customary to provide only one cooling bed for the plant having a fast-acting rotary kickout to transfer the cut lengths of pipe from the longitudinal conveyor to the transverse screw conveyors of the cooling bed. The longitudinal conveyor is operated at a higher speed than the mill and saw so that a gap is produced between the ends of successive lengths of pipe, such gap providing time for the rotary kickout to operate.

Up to the present time the mill speed has been limited and serious problems have arisen when it has been attempted to operate at speeds of 1500 feet per minute or higher because the maximum rate of operation of the rotary kickout is limited, for example, to about 40 pipe lengths per minute. Because only one cooling bed was provided, it became necessary to shut down the entire mill when there was a malfunction or break down of the bed or associated equipment.

SUMMARY OF THE INVENTION

An object of the invention is to improve the efficiency and rate of production of a pipe mill.

A further object of the invention is to provide a practical economical addition to an existing pipe mill which will reduce the overall cost of pipe manufacture.

A still further object of the invention is to provide a deflector means for the conveyors of a high-speed pipe mill which can be operated in synchronism with the saw and which can function effectively when operated at high feed rates, even in excess of 2000 feet per minute.

Another object of the invention is to provide an effective selector unit for the conveyor means of a high-speed pipe mill which is able to operate at very high speeds in deflecting successive lengths of pipe to two different conveyor paths and which has two additional adjusted positions wherein all of the pipes are caused to move to either one of the conveyor paths.

The present invention makes it possible to increase the efficiency of a pipe mill and to lower the overall cost of production. The additional equipment required over a conventional pipe mill can pay for itself in a relatively short time because it is in continual use, greatly improves the rate of output and efficiency of the mill, makes it possible to service, repair and maintain the equipment without stopping production, and reduces the need for storing a large inventory of cut pipe lengths.

The present invention involves the inclusion in a pipe mill of two cooling beds, two longitudinal conveyor paths and a unique selector unit having an oscillating deflector means for directing the pipe lengths to the conveyors paths for the two cooling beds. The selector unit is specially constructed to permit operation in three different ways. An operator at a control station can select a mode of operation wherein all of the pipe lengths are directed to the same cooling bed. The deflector means can be positioned to direct all of the pipe lengths to either one of the two beds during periods of low production or when work is being done on the other cooling bed or its conveyor.

Most of the time the deflector means of the selector unit is operated rapidly to cause successive pipe lengths to be directed alternately to different cooling beds. When operated in this manner the mill and the saw can be operated at maximum speed or at the most efficient speed. It is desirable to operate at speeds of 2000 to 2500 feet per minute, which heretofore was not feasible because of the limiting nature of the rotary kickout as explained above. The present invention permits operation at such high speeds because the selector unit functions effectively at such speeds and because more than one cooling bed is employed.

The selector unit of this invention has a deflector means which is mounted to move rapidly between a first position, wherein the pipe length discharged from the saw is deflected to a longitudinal conveyor path for the first cooling bed, and a second position, wherein the pipe length is deflected to the conveyor path for the second cooling bed. The deflector means is so moved by an actuating member having a cam follower operated by a rotary cam. The cam is operated in timed relation with the saw and the cam track is designed with suitable dwell periods so that the deflector means remains in an advanced or retracted position long enough to permit one pipe length to move past the deflector means before the deflector means is moved to a position to deflect the next pipe length.

In the preferred embodiment of the invention a rotary cam is provided having a contoured cam track at one side and a flat track at the opposite side, a cam roller is mounted for movement between a first operating position in engagement with the contoured track, wherein the deflector means is caused to oscillate in a predetermined manner in response to rotation of the cam, and a second non-operating position in engagement with the flat track, wherein the deflector bar remains stationary during rotation of the cam. A fluid cylinder is provided to hold the cam follower in either of these positions.

The rotary cam and its fluid cylinder are mounted on a frame or housing which is supported to move in a direction to cause movement of said deflector means and which is moved by another fluid cylinder. The latter can be operated when said cam roller is in said non-operating position to cause the said deflector means to be positioned and maintained in either of two positions. The unique arrangement with two fluid cylinders and an axially movable rotary cam enables the deflector means to operate in three different ways as previously described.

DESCRIPTION OF THE PREFERRED EMBODIMENT

Figure 1:
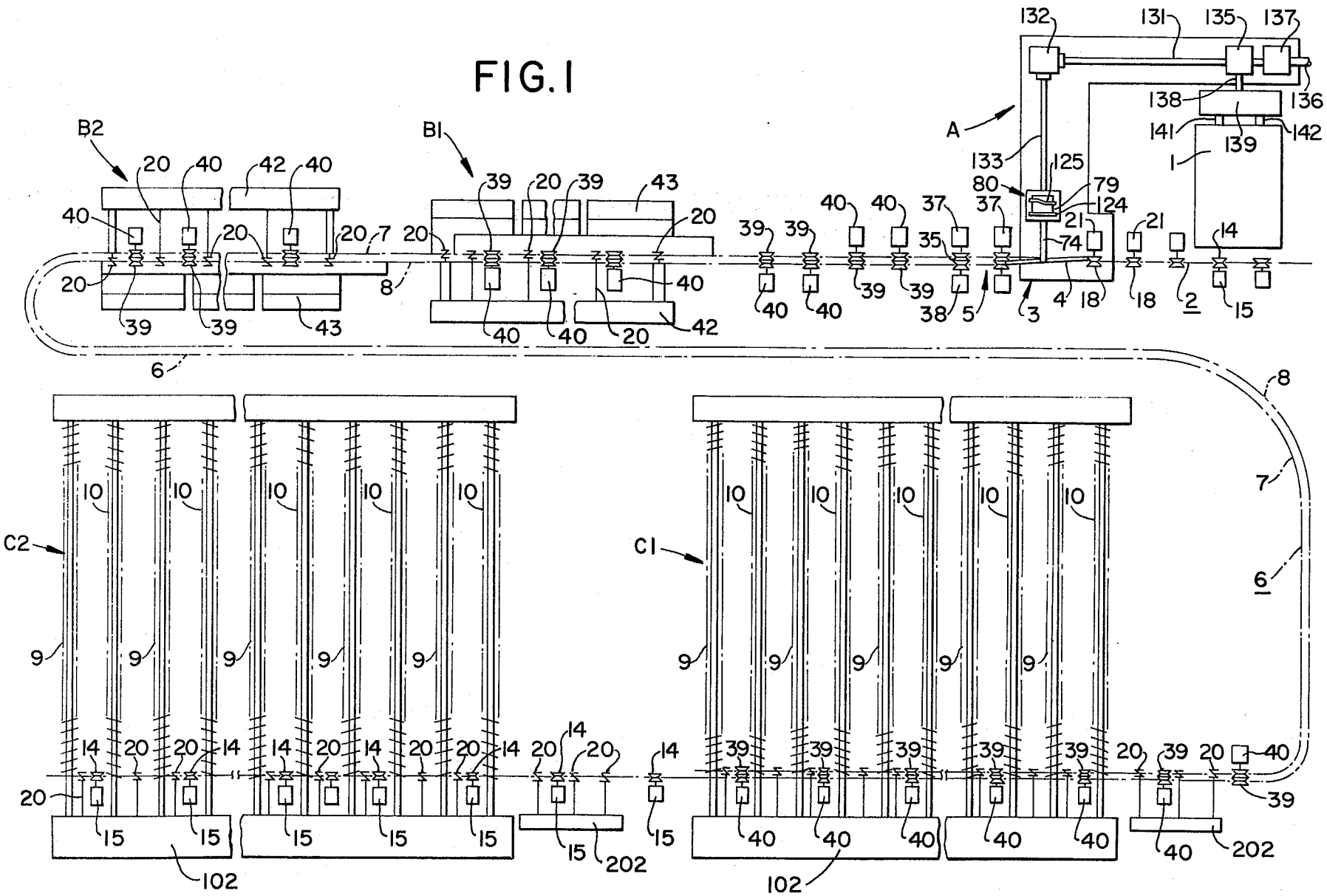
FIG. 1 is a schematic plan view to a reduced scale showing a pipe mill constructed according to the present invention.

In the drawings, in which like parts are identified by the same numerals throughout the several views, FIG. 1 is a diagrammatic showing of a pipe mill constructed in accordance with the present invention to permit operation at very high speeds. The mill discharges cut lengths of pipe from a flying saw unit 1 to a single-channel longitudinal conveyor 2 leading to the deflector section 3 of a selector unit A. A deflector means 4 is mounted in section 3 to swing between two positions and to direct the pipe alternately to different conveyor channels. A guide section 5 (FIGS. 1, 2) receives the pipe from the deflector section 3 and directs it to one side of a dual longitudinal conveyor 6 providing two conveyor paths. The first path 7 of that conveyor carries the pipe to a first cooling bed C1, and the second path 8 of said conveyor carries the pipe past the bed C1 to a second cooling bed C2.

The two cooling beds are of known construction and may be identical. They may be of the type disclosed, for example, in U.S. Pat. Nos. 2,976,980 or 3,029,922, and preferably are associated with known rotary kickout means discharging the individual lengths of pipe laterally from the longitudinal conveyor 6 to the transverse screw conyeyor of the cooling bed which has pairs of oppositely threaded and oppositely rotating screw members 9 and 10 to carry the pipe laterally away from the conveyor 6. Because the kickout means and other features of the cooling beds are known and can be as disclosed, for example, in said U.S. Pat. No. 2,976,980 details of this equipment need not be described.

In the embodiment of the invention illustrated herein, the kickout means for each of the cooling beds C1 and C2 comprises a substantial number of rotary kickouts spaced along the length of the conveyor paths 7 and 8. A relatively large number of such kickouts may be provided, and a substantial number of conveyor rolls 14 may also be provided. As indicated in the diagrammatic view of FIG. 1, an elongated housing 102 extends the length of each cooling bed, and a smaller housing 202 is provided at the incoming side of the bed.

These housings contain within them the mechanism for driving the rotary kickouts 20 and the cooling bed conveyor screws 9 and 10.

It will be understood that any one of various types of known kickout means may be employed with each cooling bed. In the embodiment illustrated herein, each rotary kickout 20 preferably comprises a rotary cam having a thread 120 in the form of a modified helix. The construction of each rotary kickout 20 and each screw 10 of the cooling beds is known and may be generally as illustrated herein in FIG. 1A and as disclosed in said U.S. Pat. No. 2,976,980.

Figures 1A, 7:
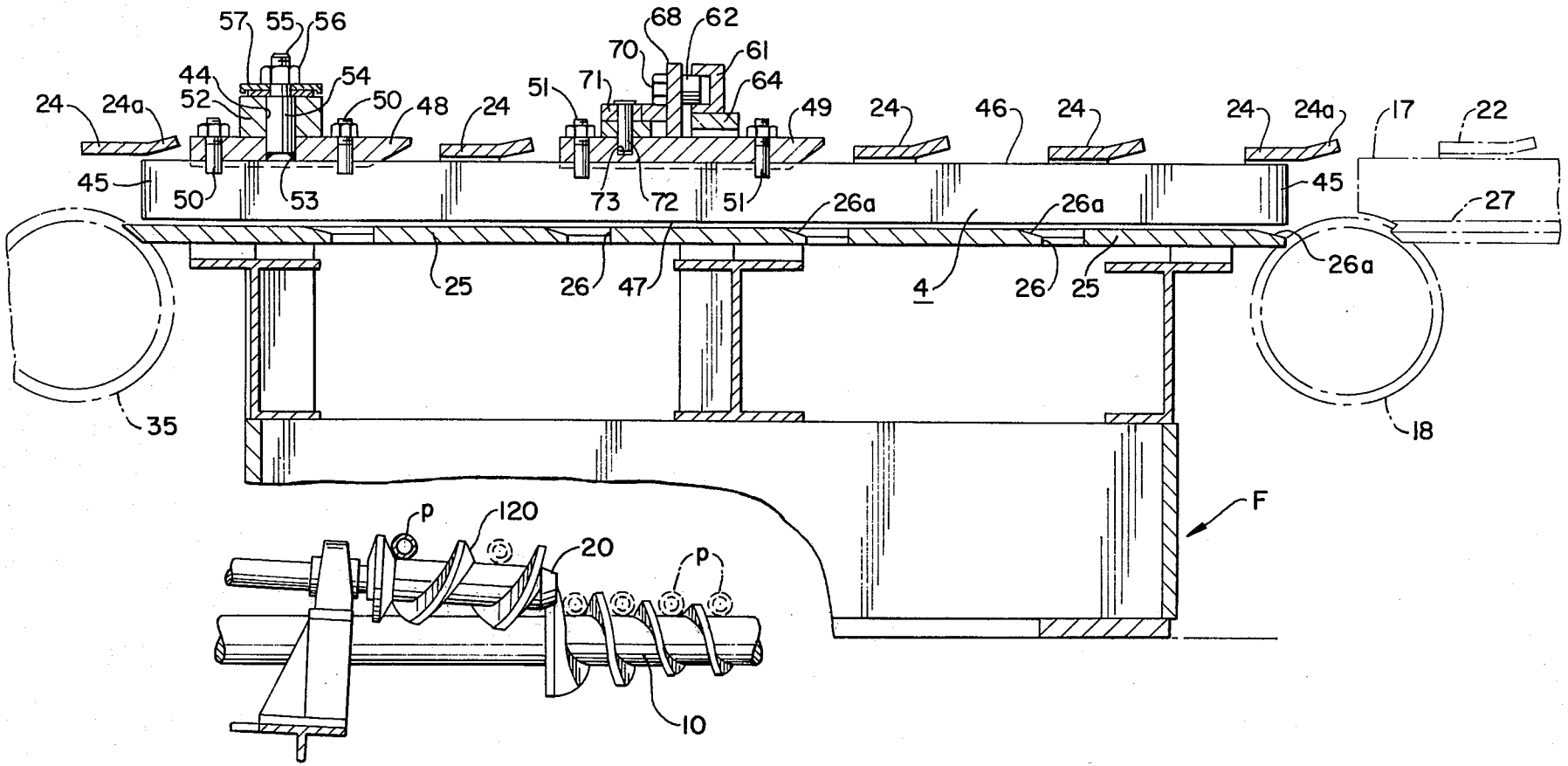
FIG. 1A is a fragmentary transverse view to a larger scale showing the rotary kickout and transverse screw conveyor of one of the cooling beds.
FIG. 7 is a vertical sectional view taken on the line 7—7 of FIG. 3 and to the same scale.

Each rotary kickout 20 of the cooling bed C2 can, for example, be arranged according to FIG. 1A to move a pipe length p from its normal position on the conveyor path 8, as shown in cross section in that figure, to a position on the conveyor screws 9 and 10 of that bed, as shown in broken lines in that figure. The rotary kickouts 20 of the cooling bed C1 can be similarly arranged to discharge pipe lengths from the conveyor path 7 to the screws 9 and 10 of that bed.

The rotary kickouts 20 are preferably arranged in each cooling bed so that in idle position they provide a clear path for longitudinal movement of the pipe lengths on the conveyors while upon rotation of all of them simultaneously (preferably through one complete revolution), the pipe length adjacent the kickout 20 is moved bodily out of its line of travel and transversely of its own axis a distance sufficient to permit the immediately following pipe length to overtake it without interference in known manner.

In a conventional pipe mill the pipe lengths are conveyed on the longitudinal conveyor in a straight line from the saw at 1 past a kickout unit, such as B1, to one cooling bed. The pipe mill shown herein differs from this in that a unique selector unit A is provided in connection with a dual conveyor 6, two kickout units B1 and B2, and two cooling beds C1 and C2.

It will be understood that the path of movement of the pipe lengths is straight all the way through the mill and from the saw at 1 to the last cooling bed C2, but it was necessary for purposes of illustration to separate sections of the mill and indicate such paths by curved broken lines. Each such line indicates a straight channel or path of the longitudinal conveyor.

Figure 2:
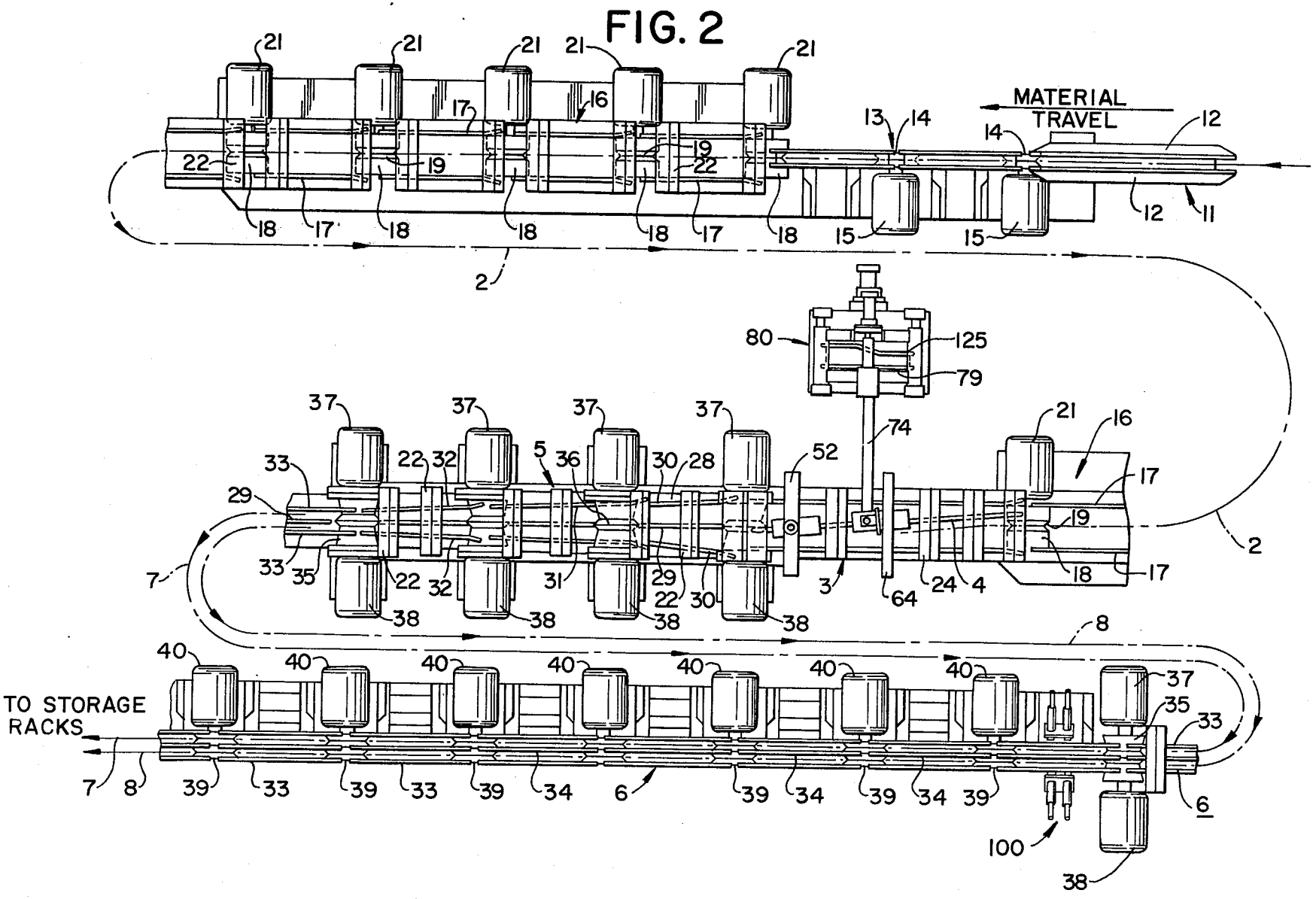
FIG. 2 is a top plan view of a part of the pipe mill of FIG. 1 to a larger scale with fragments separated to fit on the sheet.

Referring more particularly to FIG. 2, the saw outlet conveyor 2 comprises a guide section 11 having shoes 12, whose spacing may be adjusted for different pipe sizes, a regular narrow single-path trough section 13 having conventional V-groove conveyor rolls 14 driven by electric motors 15, and a special wide trough section 16. The latter has a series of vertical longitudinal side guides 17 at each side of the trough and a series of longitudinally spaced wide conveyor rolls 18, each having an external cylindrical surface cut to provide a narrow central V-groove 19 as shown. The rolls 18 are driven by electric motors 21 to advance the pipe lengths at the desired speed and are of substantial width to permit the leading ends of the pipe lengths to be deflected to either side of the central pass line at 19. A series of horizontal hold-down bars 22 extend over the wide trough of section 16 at longitudinally spaced locations to maintain the pipe lengths in a horizontal position as they arrive at the deflector section 3 of the selector unit A. Each bar 22 of section 16 is mounted at the top of the side guides 17 parallel to the flat horizontal bottom wall 27 of the trough (see FIG. 7). The bars 22 are also provided in guide section 5.

Figures 3, 8:
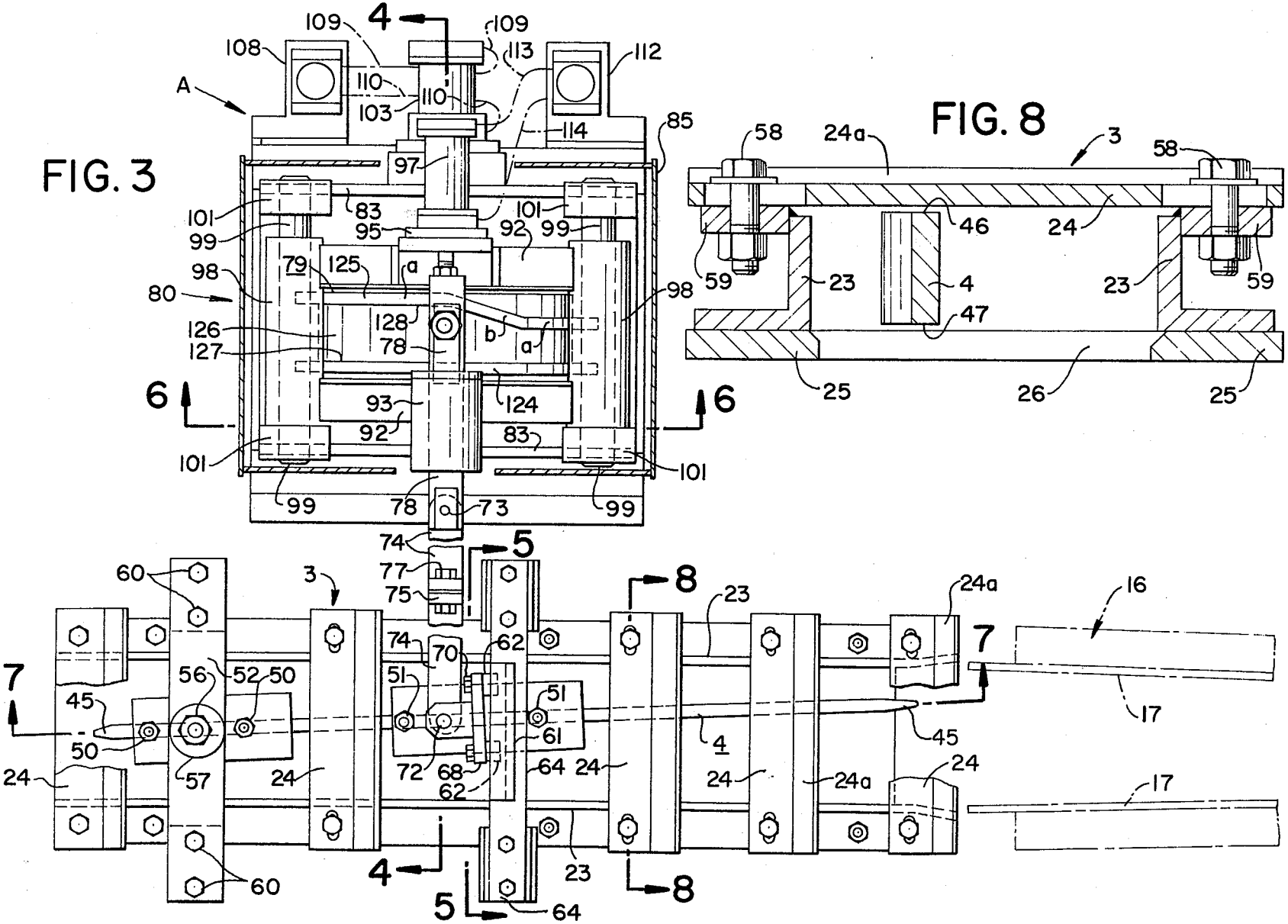
FIG. 3 is a plan view of the selector unit used in the mill of FIGS. 1 and 2 to a still larger scale.
FIG. 8 is a transverse vertical sectional view taken on the line 8—8 of FIG. 3 and to the same scale.
Figure 4:
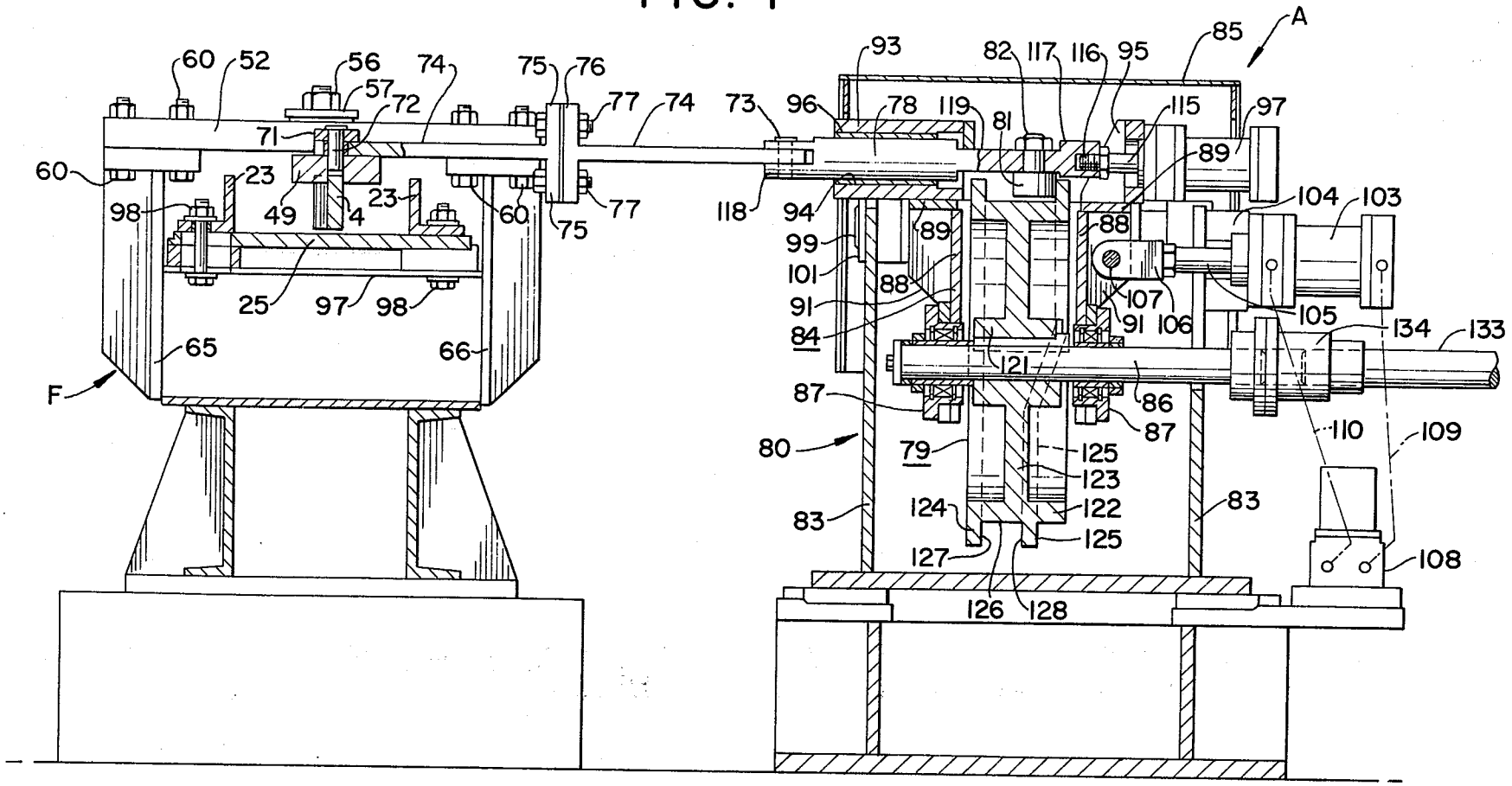
FIG. 4 is a vertical sectional view taken on the line 4—4 of FIG. 3 and to the same scale.
Figure 5:
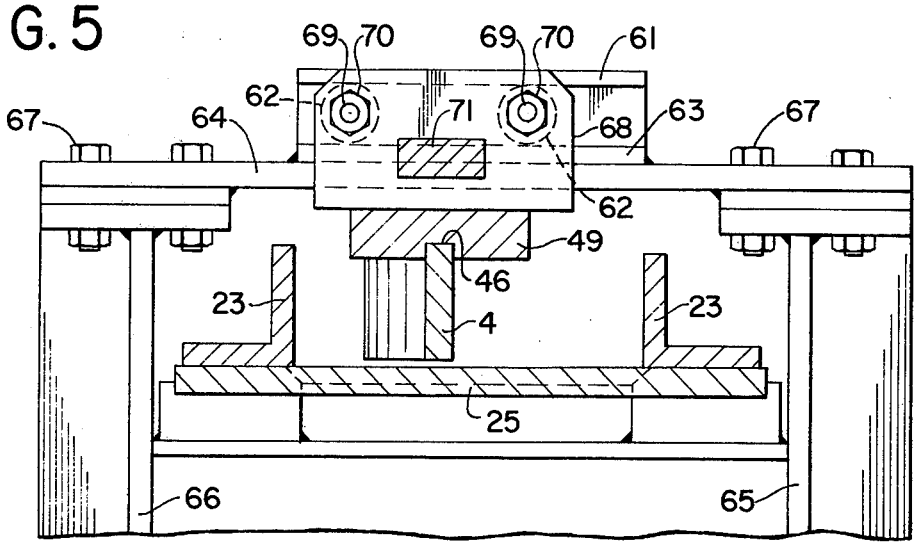
FIG. 5 is a fragmentary transverse vertical sectional view taken on the line 5—5 of FIG. 3 and to the same scale.
Figure 6:
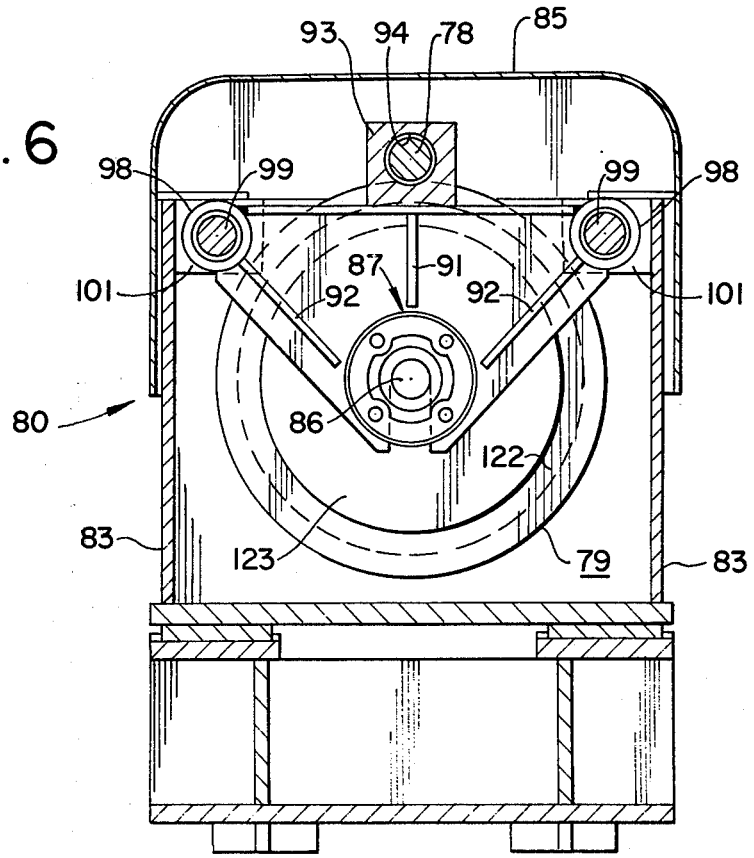
FIG. 6 is a vertical sectional view taken on the line 6—6 of FIG. 3 and to the same scale.

The deflector section 3 has a wide trough which may be somewhat wider than that of section 16. It has a pair of side guides 23 similar to guides 17, a series of longitudinally spaced horizontal hold-down bars 24 similar to bars 22, and a flat bottom wall 25 with a series of lateral slots 26 (FIGS. 7 and 8). The wall 25 and the guides 23 are rigidly mounted on support member 97 of the frame F and held in place by bolt means 98 (FIG. 4). The bars 24 have inclined front portions 24*a*, and the slots 26 have inclined front surfaces 26*a* to facilitate longitudinal movement of the pipe lengths through the trough. The hold-down bars 24 are rigidly mounted above the side guides 23 and above the deflector means 4 so as not to interfere with swinging of said deflector means. As shown the bars 24 are rigidly connected to the guides 23 by bolt means 58 and mounting plates 59 which are welded to the guides.

The guide section 5 at the discharge end of deflector section 3 has an apron 28 forming a wide trough for receiving the pipe length leaving section 3 and has a series of hold-down bars 22 above the trough. The trough has a flat straight center partition 29 extending vertically from the bottom of the trough to divide the trough into two paths or channels, each large enough to carry the pipe length from the deflector section 3 to the conveyor 6. The guide section 5 has three pairs of vertical adjustable side guides 30, 31 and 32 located at the outer sides of said channels and inclined relative to the center partition 29 as shown in FIG. 2 to provide two paths or channels which gradually decrease in width from the inlet to the discharge end. The width of these channels can be adjusted in accordance with the pipe diameter.

The dual conveyor 6 has a pair of parallel vertical side guides 33 and central vertical partition 34 defining two paths or channels 7 and 8 of uniform width for receiving the pipe length discharged from guide section 5. If desired the guides 33 may be adjustably mounted to permit adjustment of the channel width, in which case the side guides 32 would be adjusted accordingly.

The section 5 is preferably provided with suitable rollers and suitable drive means. As herein shown, a series of longitudinally spaced lateral conveyor rollers 35 are provided, each having a raised center portion 36 and a "W" profile. Essentially the rollers provide a V-groove for the path or channel at each side of the centerline at 29. The rollers may be driven by electric motors 37 and 38. If desired separate motor-driven V-groove rollers may be provided at each side of said centerline.

The dual conveyor 6 may be provided with rollers and drive means similar to those of the guide section 5. As herein shown, the conveyor has a large number of double-V rollers 39 of W configuration driven by electric motors 40. They are spaced along the entire length of the dual conveyor 6 to the end of the first cooling bed C1. Beyond that bed, the conveyor 6 has a series of conventional V-groove rollers 14 spaced along its length and driven by electric motors 15 (see FIG. 1).

The conveyor rollers 39 carry the pipe lengths in tandem from guide section 5 past the reject kickout units B1 and B2 to the first cooling bed. Each of said units has conventional rotary kickouts 20 driven by suitable mechanism within the housing 42 and has a conventional reject cradle 43. The unit B1 is positioned to service the path 8 of the dual conveyor, and the unit B2 is positioned in the opposite manner to service the path 7. Thus the pipe lengths can be ejected from both of the conveyor paths 7 and 8 by the rotary kickouts 20 in the same way as they are ejected at the cooling beds.

The selector unit A is specially constructed to provide three modes of operation and may be operated from an operator control station to direct all of said pipe lengths to path 8, or to oscillate and direct every other pipe length to path 8. This may be accomplished in various ways.

In the preferred embodiment of the invention illustrated in FIGS. 3 to 8, the deflector means 4 is a flat steel bar having tapered end portions 45 and flat horizontal upper and lower surfaces 46 and 47 parallel to the bottom wall 25 of the trough and to the bottom surfaces of the hold-down bars 24. Flat rectangular horizontal plates 48 and 49 are rigidly connected to deflector means by bolt means 50 and 51. The plate 48 is located at the flat bottom face of the horizontal transverse bar 52 and has a cylindrical hole 53 which receives a vertical cylindrical pivot pin 54. The bar 52 is rigidly mounted on the frame F by bolt means 60. The pin 54 is welded to or otherwise rigidly connected to plate 48 and fits in a cylindrical hole 44 in the bar 52. The upper end of the pin is externally threaded to receive a nut 56 and a washer 57, whereby deflector means 4 pivots about the pin 54 and is supported by the washer.

Means are provided at plate 49 for supporting the weight of the deflector means and maintaining it in a horizontal position as it swings on pivot pin 54. Such means includes a horizontal transverse track 61 and a pair of supporting rollers 62 which rest on the flat horizontal bottom flange 63 of the track. The track 61 is rigidly mounted on a horizontal transverse supporting bar 64 similar to bar 52. The bar 64 is rigidly mounted on the two side support members 65 and 66 of the frame F in the same manner as bar 52 using bolt means 67 similar to bolt means 60.

The rollers 62 are mounted for rotation on a transverse vertical plate 68 by means of stub shafts 69 threaded at their ends to receive nuts 70. The transverse plate 68 is welded to or otherwise connected to the plate 49 and has a horizontal projecting portion 71 with a cylindrical hole to receive a vertical cylindrical pivot pin 72. The plate 49 has a similar hole 73 of the same diameter to receive the bottom end of pin 72.

A horizontal actuating means 74 is pivotally connected to the deflector means 4 of the selector unit A to effect horizontal swinging movement thereof between a first position as shown in FIG. 3, inclined somewhat relative to the side flanges 23, and a second oppositely inclined position. One end portion of the actuating means 74 has a cylindrical hole to receive the pivot pin 72 and is sandwiched between the projection 71 and the plate 49. At the other end, the actuating means has a hole to receive a pivot pin 73. As shown the actuating means 74 is made in two pieces having flanges 75 and 76 rigidly connected by bolt means 77, but it will be apparent that a one-piece construction can also be used.

The selector unit A has a cam assembly 80 for effecting reciprocation of the actuating means 74 including a rotary cam 79 and a cam follower roller 81 carried by an actuating rod 78. The cam assembly is spaced from the longitudinal conveyor and deflector section 3 and has a separate frame including a stationary base 83 and a housing 84 mounted to reciprocate in an axial direction parallel to the actuating rod 78. The cam assembly 80 may also have a removable sheet metal cover 85.

The actuating rod 78 is externally cylindrical to fit the sleeve 96 and is machined to provide a bifurcated end portion 118 for receiving the end of member 74 and the pin 73, a threaded hole at the opposite end for receiving the end portion 116 of the piston rod, and a flattened intermediate portion 119 with a cylindrical hole for receiving the stub shaft 82 of the cam roller.

The rotary cam 79 is mounted on a horizontal shaft 86 which is journaled for rotation in antifriction bearings 87 carried by the housing 84. The bearings are carried by the two vertical supporting plates 88 of the housing, which are welded to horizontal plates 89 and reinforcing plates 91 and 92. One of the vertical reinforcing plates 91 is welded to a block 93 having a cylindrical bore 94 to receive the horizontal actuating member 78 and a bearing sleeve 96. The other plate 91 is welded to a support block 95 which supports a power cylinder 97 having a piston rod 115 with a threaded end portion 116 screwed into the enlarged end portion 117 of the rod 78. The inclined reinforcing plates 92 are welded to cylindrical support sleeves 98, which slide axially on cylindrical guide rods 99 in a direction parallel to the shaft 86 and the rod 78.

The two rods 99 are rigidly supported on the base 83 by four blocks 101 rigidly connected as by welding to the vertical walls of the base 83 at the four corners of the assembly 80. The blocks 101 for each rod 99 are spaced apart a distance greater than the axial length of the sleeves 98 to provide the desired maximum axial movement for the housing 84. Such axial movement is effected by a power cylinder 103 which is rigidly mounted on the base 83 by means of a supporting block 104. The piston rod 105 of the cylinder 103 has a yoke portion 106 connected to the plate 91 of the housing 84 by means of a horizontal pin 107, whereby the housing may be advanced or retracted by supplying air under pressure to one side or the other of the piston. An air valve 108 is provided at one side of unit A to control operation of the air cylinder 103 and has air lines 109 and 110 leading to opposite ends of the cylinder.

A similar air valve 112 is provided at the opposite side of the unit A with flexible air lines 113 and 114 leading to opposite ends of the air cylinder 97. The valves 108 and 112 may be identical and are preferably reciprocating four-way solenoid-operated valves controlled electrically at a single control station.

FIG. 4 shows the position of the parts when the valve 108 is positioned to supply air to one end of the cylinder 103 through line 110. In this position the piston rod 105 is fully advanced to hold the housing 84 in its normal operating position. As shown, the piston rod 115 of the air cylinder 97 is fully retracted and holds the cam follower 81 against the contoured cam track of the cam 79. The air valve 112 maintains the cam follower in such position by supplying air to the cylinder through line 114 while exhausting air through line 113.

The cam 79 shown herein is in the form of a wheel having a hub portion 121 mounted on and keyed to the shaft 86, an annular rim portion 122, and an intermediate annular portion 123 extending radially between the hub and rim portions. The cam wheel has two integral radial flanges 124 and 125 at opposite ends of the rim portion 122 defining a peripheral channel for receiving the cam follower 81. The rim portion 122 has an external cylindrical surface 126 forming the bottom of said channel and extending between the radial flanges. The cylindrical surface 126 is preferably spaced from and out of contact with the cam follower 81 as shown in FIG. 4. The flange 124 has a flat vertical surface 127 perpendicular to the axes of rotation of the shaft 86, which is engageable with the cam follower 81 when the piston rod 115 is advanced by the piston of cylinder 97.

The flange 125 is the operating element of the rotary cam 79 and has a contoured vertical surface 128 which forms the cam track for follower 81. The flange has a pair of flat portions *a* parallel to the flange 124 and spaced different distances therefrom and a pair of inclined portions *b* extending between the portions *a* as shown in FIG. 3. One of the portions *b* engages the cam follower 81 to force it in an axial direction toward the section 3 and to cause movement of the deflector means 4 from the inclined position of FIG. 3 to an oppositely inclined position of FIG. 3 at the opposite side of the trough. As the portion *b* moves past the cam follower, the piston rod 115 is extended, the air pressure in the cylinder 97 yieldably resisting such movement and holding the follower in engagement with the cam track surface 128.

The flange 125 is designed to provide a suitable dwell period so that the deflector means 4 remains in a fixed position long enough to allow one pipe to enter one conveyor path before the next pipe is directed to the other conveyor path. The dwell period is preferably at least several times the time required to move said deflector means from its advanced position to its retracted position. This dwell is provided by the flat portions *a* of the flange 125, each of which may, for example, extend 145° to 160° around the circumference. Each of the inclined portions *b* extends only 20° to 35° around the circumference. The flange 125 may, for example, be shaped to cause the cam follower 81 to dwell in a retracted position during the first 150° of cam rotation, to shift axially from that position to an advanced position adjacent flange 124 during the next 30° of cam rotation, to dwell in said advanced position during the next 150°, and to shift back to the original retracted position during the last 30°.

FIG. 1 of the drawings indicates diagrammatically that the rotary cam 79 is driven in timed relation to operation of the flying hot saw equipment 1 of the pipe mill. Such saw equipment may be of a known type, such as disclosed in U.S. Pat. Nos. 2,645,001, 2,775,808 or 2,836,880.

In the preferred embodiment the known flying hot saw equipment 1 (FIG. 1) includes a rotating circular saw blade (not shown) that orbits about an axis perpendicular to the longitudinal path of travel of the pipe, and means for causing the saw blade to travel longitudinally along with the pipe at essentially the same velocity when the blade is cutting the pipe. The pipe normally travels in a path which is adjacent to but does not intersect the path of the moving saw, and means such as a cam wheel is provided which operates periodically to move the pipe laterally thereof into the path of the saw at the proper time to cut the pipe into pieces of the desired length. Such pipe deflecting means must be operated in synchronism with the longitudinal movement of the saw as is known. A main drive motor is preferably used to drive the crank mechanism which moves the saw in its orbital path and to drive the cam wheel, whereby these elements are driven in synchronism. The equipment can be adjusted by known means for accurate cutting of pipe into a wide range of commerical lengths, for example, by controlling the frequency with which the saw is caused to intersect the path of the pipe (i.e., whether a cut is made every one, two, four or eight revolutions of the saw in its orbit.) This is described in more detail in the aforesaid patents, the disclosure of which is hereby incorporated by reference.

The driving means for the rotary cam 79 of the assembly 80 is illustrated diagrammatically in FIG. 1, it being understood that various other arrangements can also be used to achieve the necessary synchronism. Such driving means includes a shaft means 131, a gear reduction means 132 and a long shaft 133, which is connected to the cam shaft 86 by a coupling means 134 (FIG. 4). The drive means may be operably connected to the hot flying saw at 1 in various ways. As shown in FIG. 1, a gear reduction means 135 is connected to the end of shaft 131 and receives part of the power from the main power source (not shown) through a shaft 136 and a coupling means 137. The means 135 has a shaft 138 which transmits part of the power to the flying saw through a gear reduction means 139 and a pair of drive shafts 141 and 142. The shaft 141 drives the work-deflecting cam wheel, and the shaft 142 drives the crank mechanism to move the saw in its oribtal path, whereby the cam wheel and the crank mechanism operate in synchronism.

In the pipe mill of FIG. 1, one length of pipe is cut during each two revolutions of the saw crank mechanism (not shown). The gearing between shaft 133 and 142 is selected so that said crank mechanism makes four revolutions while the shaft 133 and the cam 79 make only one revolution. This 4:1 ratio enables the selector unit A to swing the deflector means 4 back and forth in such manner as to deliver successive pipe lengths to opposite sides of the dual conveyor 6. The deflector means can be oscillated at a high frequency and functions effectively even when the pipe mill delivers pipe lengths at speeds of 1,500 to 3,000 feet per minute.

The operation of the pipe mill may be controlled by an operator at a control station in a remote location. The operator may select any one of three different modes of operation, for example, by pushing one of three different push buttons. If the operator desires normal operation and pushes the appropriate button, solenoids are operated to cause the valve 108 to move to a normal operating position, wherein air is supplied to line 109 and exhausted from line 110 of the air cylinder 103, and to cause the valve 112 to move to a normal operating position, wherein air is supplied to line 114 and exhausted from line 113 of the air cylinder 97. This causes the cam 79 to be advanced axially and the cam follower 81 to be retracted and held against the contoured cam track of flange 125 as indicated in FIGS. 3 and 4. This causes the deflector means 4 to be swung or oscillated horizontally toward and away by the cam 79 between a first position as shown in FIGS. 3 and 8, wherein the deflector means is inclined relative to the normal line of travel in a direction to deflect the pipe length from section 116 to the conveyor path 8 of the second cooling bed C2, and a second position (not shown), wherein the deflector means is inclined the same amount relative to said line of travel but in the opposite direction to deflect the pipe length from section 16 to the conveyor path 7 of the first cooling bed C1. In each of said first and second positions the leading end 45 of the deflector means remote from the pivot pin 54 may be closely adjacent to or spaced a short distance from the guide 23 at the side of the trough. Said end 45 should be positioned far enough from the centerline of the trough to function in the intended manner.

The deflector means 4 is caused to dwell in each of said first and second positions each time the follower 81 rides on the flat portions *a* of the cam track and is caused to move rapidly from one position to the other each time the follower rides on the inclined portions *b*. The rapidity of such movement depends on the steepness of the incline at *b* and the speed of the mill and the saw. Where each portion *b* is shaped to complete such movement during only 2° or 3° of rotation of the cam 79, the movement can be very rapid especially when handling pipes traveling at speeds of 2000 to 3000 feet per minute. The equipment functions very well, for example, when handling 20-foot or 40-foot lengths of pipe traveling at 2,500 feet per minute or more.

If there is a jam up at one of the cooling beds or if it is necessary to carry out repair or maintenance operations, the operator at the control station can push a second button to reverse the position of the air valve 112 and cause air under pressure to be supplied to the cylinder 97 through line 113 and exhausted therefrom through line 114. This causes the piston rod 115 to advance the follower 81 out of contact with and out of the path of movement of the flange 125 and to hold the follower against the flat surface 127 of the flange 124, whereby the oscillation of the deflector means 4 ceases and it remains in a position to deliver all of the pipes to the conveyor channel 7 of the first cooling bed.

If it is desired to send all of the pipe lengths to conveyor channel 8 instead of channel 7, a third button may be pushed to reverse the position of the air valve 108 (FIG. 3) and to cause air under pressure to be supplied to cylinder 103 through line 110 and exhausted through line 109, whereby the entire housing 84, including the cam wheel 79, the air cylinder 97 and the cam shaft 86, is retracted a short distance from the position shown in FIGS. 3 and 4 to a position wherein the deflector means 4 has the same location as in FIG. 3. Said short distance is equal to the distance shown in FIG. 4 from surface 127 to the cam follower 81 or at least sufficient to move the deflector bar 4 to the desired position.

Thus any of the three modes of operation can be selected by the operator at the control station merely by controlling the solenoids of the two air valves 108 and 112.

The coupling means 134 can be constructed to permit an axial movement of the shaft 86 relative to the shaft 133 equal to the amount of movement of the piston rod 105. However, this is not essential because the shaft 133 can be made long enough to accommodate the required movement by flexing.

It will be understood that, in accordance with the provisions of the patent laws, variations and modifications of the specific methods and devices disclosed herein may be made without departing from the spirit of the invention.

Having described our invention, we claim:

1. In combination in a pipe mill of the character described having means for delivering successive pipe lengths, first longitudinal conveyor means receiving said pipe lengths in tandem in a single row with the leading end of one pipe length spaced from the trailing end of the preceding pipe length, second longitudinal conveyor means providing two separate longitudinal pipe conveying paths, each adapted to carry pipe lengths, a pair of cooling beds adjacent said two paths, each bed having a transverse conveyor for receiving pipe lengths from one path of said second conveyor means, and a selector unit having a deflector means for guiding the pipe lengths from said first longitudinal conveyor means, said deflector means being mounted to move between an advanced position, wherein a pipe length is guided from said first conveyor means to one of the two paths of said second conveyor means, and a retracted position, wherein a pipe length is guided from said first conveyor means to the other of said two paths, said selector unit having actuating means, said actuating means comprising a rotary cam and a cam follower connected to said deflector means, said rotary cam having a contoured cam surface engageable with said follower which actuates said follower in a direction to cause movement of said deflector means between its retracted position and to its advanced position, a fluid cylinder is provided having a piston for moving said follower toward and away from said cam surface, and separate means are provided for moving all portions of said rotary cam in said last named direction.

2. In combination in a pipe mill of the character described having means for delivering successive pipe lengths, first longitudinal conveyor means receiving said pipe lengths in tandem in a single row with the leading end of one pipe length spaced from the trailing end of the preceding pipe length, second longitudinal conveyor means providing two separate longitudinal pipe conveying paths, each adapted to carry pipe lengths, a pair of cooling beds adjacent said two paths, each bed having a transverse conveyor for receiving pipe lengths from one path of said second conveyor means, and a selector unit having a deflector means for guiding the pipe lengths from said first longitudinal conveyor means, said deflector means being mounted to move between an advanced position, wherein a pipe length is guided from said first conveyor means to one of the two paths of said second conveyor means, and a retracted position, wherein a pipe length is guided from said first conveyor means to the other of said two paths, said selector unit having actuating means for moving said deflector means between said advanced position and said retracted position in timed relation to the movement of the pipe lengths, said actuating means having a rotary cam and a cam follower operably connected to said deflector means, wherein biasing means are provided for holding said follower in engagement with said cam to cause oscillation of said deflector means to cause successive pipe lengths to be directed to opposite sides of said second conveyor means, and wherein means are provided for holding said follower out of engagement with said cam to prevent oscillation of said deflector means.

3. A combination as defined in claim 2 wherein means are provided for moving said deflector means between said retracted and advanced positions while said follower is held out of engagement with said cam so that all of the pipe lengths may be diverted to either one of the two paths of said second conveyor means.

4. A combination as defined in claim 2 wherein said biasing means comprises a fluid cylinder having a piston operably connected to said follower.

5. A combination as defined in claim 4 wherein said fluid cylinder can be operated in one direction to hold said follower against said cam and in the opposite direction to move said follower to a non-operating position.

6. In a pipe mill of the character described, first longitudinal conveyor means; second conveyor means providing a pair of longitudinal pipe conveying paths for receiving pipe lengths delivered from said first conveyor means; deflector means mounted to swing from a retracted position wherein each pipe length is directed from said first conveyor means to one path of said pair of paths to an advanced position wherein each pipe length is directed from said first conveyor means to the other path of said pair; and means for swinging said deflector means between said advanced and retracted positions comprising rotary cam means, means for rotating said cam means, and cam follower means mounted to move from an operating position in engagement with said cam means to a non-operating position, biasing means for moving said follower means to said operating position and for holding it in contact with said cam means, retracting means for moving said follower means from said operating position to said non-operating position, actuating means connected between said follower means and said deflector means to effect swinging of said deflector means in response to movement of said follower means; and means for moving said follower means and said actuating means independently of the rotation of said cam means to effect movement of said deflector means for maintaining said deflector means in one of those positions while said follower means is in said non-operating position.

7. In a pipe mill of the character described, first longitudinal conveyor means, second conveyor means providing a pair of longitudinal channels for receiving pipe lengths delivered from said first conveyor means, deflector means mounted to move from a retracted position wherein each pipe length is directed from said first conveyor means to one channel of said pair of channels to an advanced position wherein each pipe length is directed from said first conveyor means to the other channel of said pair; and means for moving said deflector means between said advanced and retracted positions comprising a rotary cam having a peripheral flange defining a cam track, an adjustable support, means mounting said cam on said support for rotation about an axis, a follower mounted to move axially relative to said rotary cam from a normal operating position in engagement with said cam track to a non-operating position out of contact with said track, said follower being operably connected to said deflector means, said cam track being shaped to cause said follower to reciprocate said deflector means between said advanced position and said retracted position, and a fluid cylinder mounted on said support and having reciprocating piston means for moving said follower between said operating position and said non-operating position and for yieldably holding the follower against said cam track as the follower is reciprocated.

8. A combination as defined in claim 7 wherein means are provided for moving said support axially to move said follower and rotary cam to move said deflector means between said advanced position and said retracted position while said follower is in said non-operating position.

9. A combination as defined in claim 7 wherein said rotary cam has a flat peripheral flange and said fluid cylinder holds said follower in said non-operating position against that flange.

10. A combination as defined in claim 7 wherein a second fluid cylinder is provided having reciprocating piston means for moving said support axially, a fluid valve is provided to control reciprocation of each of said fluid cylinders, and solenoid means are provided to move each fluid valve.

11. A combination as defined in claim 10 wherein said second fluid cylinder effects movement of said deflector means from said advanced position to said retracted position when said follower is held in said non-operating position whereby the deflector means can be moved to a fixed position to deliver pipe lengths from said first conveyor means to either one of said conveyor channels or can be rapidly oscillated to deliver pipe lengths alternately to both of said conveyor channels.

12. In a pipe mill of the character described, means for receiving successive pipe lengths and for guiding each pipe length to either one of two separate paths including deflector means mounted to move from a retracted position, wherein each pipe length is directed to one of said paths, to an advanced position, wherein each pipe length is directed to the other of said paths, means for moving said deflector means between said advanced and retracted positions comprising a rotary cam having a peripheral flange defining a cam track, an adjustable support, means mounting said cam on said support for rotation about an axis, a follower mounted to move axially relative to said rotary cam from a normal operating position in engagement with said cam track to a non-operating position out of contact with said track, said follower being operably connected to said deflector means, said cam track being shaped to cause said follower to reciprocate said deflector means between said advanced position and said retracted position, a fluid cylinder mounted on said support and having reciprocating piston means for moving said follower between said operating position and said non-operating position and for yieldably holding the follower against said cam track as the follower is reciprocated, and means for moving said support axially to effect movement of said deflector means between said advanced and retracted positions while said follower is held in said non-operating position, whereby the deflector means can be moved to a fixed position to deliver pipe lengths to either one of said paths or can be rapidly oscillated to deliver pipe lengths alternately to both of said paths.

13. A combination as defined in claim 12 wherein said rotary cam has a flat peripheral flange, said fluid cylinder is adapted to hold said follower in said non-operating position against that flange, a second fluid cylinder is provided for moving said support axially, a valve is provided to control the supply of motive fluid to said cylinders, and means are provided for moving each valve.

* * * * *